US005174139A

United States Patent [19]

Huang

[11] Patent Number: 5,174,139

[45] Date of Patent: Dec. 29, 1992

[54] KEY RING HOLDER WITH HANGER LOOP FOR HANGING

[76] Inventor: Yu-Hwei Huang, 1/f, No. 5, Alley 2, Lane 85 Min-Tsu Rd., Lu-chou Hsiang, Taipei Hsien, Taiwan

[21] Appl. No.: 827,999

[22] Filed: Jan. 30, 1992

[51] Int. Cl.[5] ..... A47G 29/10

[52] U.S. Cl. ..... 70/456 R; 24/3 K; 24/599.2; 70/459; 206/37.5

[58] Field of Search ..... 70/456 R, 459; 24/3 K, 24/599.2, 599.3; 206/37.5

[56] References Cited

U.S. PATENT DOCUMENTS

| | | | |
|---|---|---|---|
| 2,115,342 | 4/1938 | Moore | 70/456 R |
| 3,551,015 | 12/1970 | Whiteside et al. | 411/504 X |
| 3,597,951 | 8/1971 | Nadel | 70/459 |
| 4,584,858 | 4/1986 | Wolfer | 70/459 X |
| 4,821,543 | 4/1989 | Scungio | 70/456 R |
| 5,009,557 | 4/1991 | Dessirier | 411/504 |
| 5,031,430 | 7/1991 | Nelson | 70/456 R |
| 5,050,414 | 9/1991 | Huang | 70/459 X |

*Primary Examiner*—Lloyd A. Gall
*Attorney, Agent, or Firm*—Bacon & Thomas

[57] ABSTRACT

A key ring holder comprising a hanger loop secured to two symmetrical passage ways on a circular groove around the peripheral wall of a flat, circular base thereof by a metal bolt, a compression spring and a washer is disclosed. The compression spring and the washer are sleeved on the metal bolt and stopped between a contracted hole at one end of a stepped through hole inside the flat, circular base and an expanded bottom end of the metal bolt. The hanger loop is constantly pulled downwards by the compression spring and the metal bolt to block up the two symmetrical passage ways. Pulling the hanger loop upwards from the flat, circular base and rotating it sideways causes the two symmetrical passage ways to be opened for fastening key rings to the circular, flat base.

1 Claim, 3 Drawing Sheets

KEY RING HOLDER WITH HANGER LOOP FOR HANGING

BACKGROUND OF THE INVENTION

The present invention relates to key ring holders. More particularly, the present invention relates to a key ring holder with a hanger loop for hanging.

Several structures of key ring holders have been disclosed for holding key rings so that bunches of keys can be orderly arranged and carried. A key ring holder is generally made in a flat, circular shape and may be attached with a hook or swivel type snap hook for hanging. A swivel type snap hook is generally comprised of a hook having a latch means controlled by a spring means for locking and unlocking control. This structure of swivel type snap hook is still not satisfactory in use because the spring means thereof may be damaged easily.

SUMMARY OF THE INVENTION

The present invention is to provide a key ring holder with a hanger loop which is durable and practical in use. According to the present invention, there is provided a key ring holder which is generally comprised of a hanger loop secured to two symmetrical passage ways on a circular groove around the peripheral wall of a flat, circular base thereof by a metal bolt, a compression spring and a washer. The compression spring and the washer are sleeved on the metal bolt and stopped between a contracted hole at one end of a stepped through hole inside said flat, circular base and an expanded bottom end of the metal bolt. The hanger loop is constantly pulled downwards by the compression spring and the metal bolt, to block up the two symmetrical passage ways. Pulling the hanger loop upwards from the flat, circular base and rotating it sideways causes the two symmetrical passage ways to be opened for fastening key rings to the circular groove of the circular, flat base.

DETAILED DESCRIPTION OF THE PREFERRED EMBODIMENT

Figure 1:
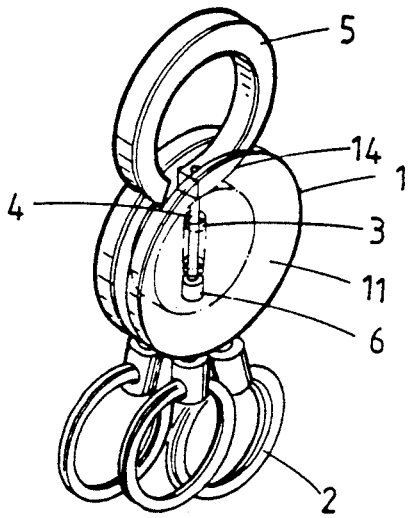
FIG. 1 is a perspective view of a key ring holder embodying the present invention.
Figure 2:
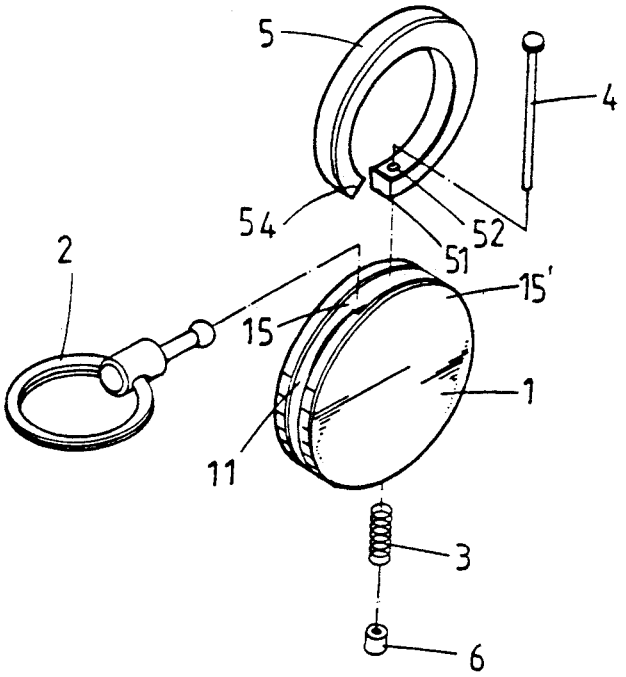
FIG. 2 is an exploded view thereof.

Referring to FIGS. 1 and 2, a key ring holder is generally comprised of a base 1, a compression spring 3, a metal bolt 4, a washer 6 and a hanger loop 5 for holding a plurality of key rings 2. The base 1 of the key ring holder comprises a circular groove 11 around the peripheral wall thereof, a stepped through hole through an axis thereof formed of a cylindrical hole 12 and a contracted or reduced diameter hole 13 concentrically aligned at one end, an arched shaped concavity 14 on said circular groove 11 above said contracted hole 13 forming symmetrical passage ways 15, 15'. The main feature of the present invention is at the hanger loop 5. The hanger loop 5 is made from a strip formed into the shape of a loop having a gap 51 defined between the two opposite ends 52, 54 thereof, wherein one end 52 of the hanger loop 5 has a round hole 52 thereon. During the assembly process of the present invention, the gap 51 of the hanger loop 5 is placed in the arched shaped concavity 14 at the middle, the metal bolt 4 is inserted through the round hole 52 on one end 51 of the hanger loop 5 into the contracted hole 13 and the cylindrical hole 12. then, the compression spring 3 and the washer 6 are properly inserted into the cylindrical hole 12 from the bottom end thereof and sleeved on the metal bolt 4, and then, the plain end of the metal bolt 4 is hammered down to form another head (not shown) for retaining washer 6 on bolt 4. Therefore, the compression spring 3 becomes firmly retained between the wahser 6 and the contracted hole 13.

Figure 3:
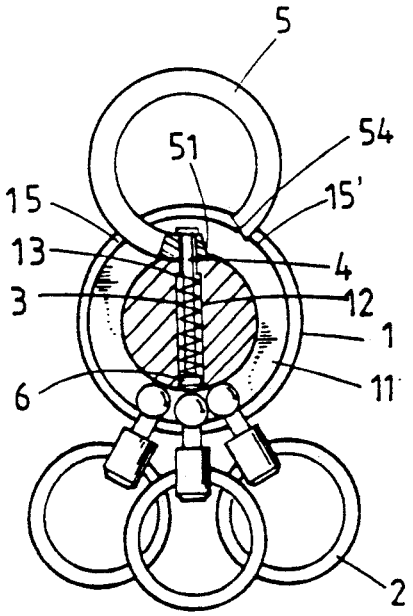
FIG. 3 is a front sectional view thereof.
Figure 4:
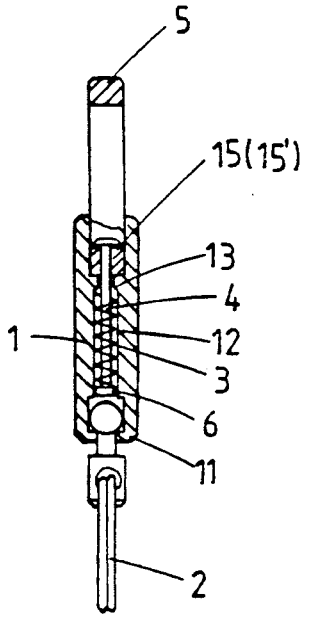
FIG. 4 is a side sectional view thereof.

Referring to FIGS. 3 and 4, the metal bolt 4 is constantly pulled downwards in the cylindrical hole 12 by the compression spring 3 causing the hanger loop 5 to be firmly secured in the arched shaped concavity 14 and therefore, the two symmetrical passage ways 15, 15' are blocked by the opposite end 54 of the hanger loop 5.

Figure 5:
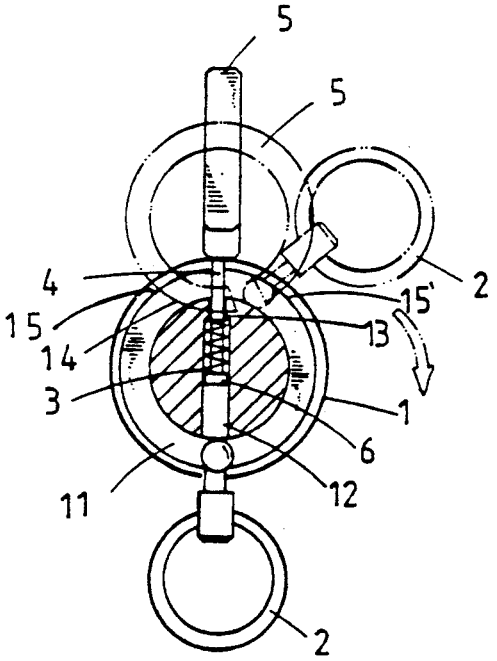
FIG. 5 is a schematic drawing showing that the hanger ring is pulled upwards from the base and rotated through an angle of 90° to open the two symmetrical passage ways for fastening key rings.

Referring to FIG. 5, the hanger loop 5 can be pulled upwards from the base 1 and rotated through a certain angle to open the symmetrical passage ways 15, 15' for fastening key rings 2 in the circular groove 11 on the base 1. After the key rings 2 having been fastened in the circular groove 11 on the base 1, the hanger loop 5 is rotated back to its original position with the end 54 thereof stopped at the passage ways 15, 15', and therefore, the key rings 2 can be moved along the circular groove 11 and will not disconnect from the base 1. By means of the hanger loop 5, the key ring assembly can be hung on a belt or any supporting object.

What is claimed is:

1. A key ring holder comprising:

a circular base having two substantially flat sides and a peripheral wall portion, said base including an annular groove formed in said peripheral wall portion and a hole extending therethrough between said two substantially flat sides, said hole including a first diametric cylindrical portion extending through a substantial portion of said base and a second reduced diameter cylindrical portion, said base further being formed with an arch-shaped concavity in said peripheral wall portion that extends above the second reduced diameter cylindrical portion of said hole and defines two symmetrical passageways that open into said annular groove;

a hanger member in the general shape of a loop with a gap defining two ends, one of said ends including a hole extending therethrough; and means for attaching said hanger member to said base so as to selectively block and permit access to said two symmetrical. passageways, said attaching means including a bolt having first and second ends with a head formed integral with said first end, a compression spring and a washer, said bolt extending through said hole formed in said one end of said hanger member such that said head abuts said hanger member, said bolt further extending through the second reduced diameter cylindrical portion of the hole formed in said base and into the first diametric cylindrical portion, said compression spring being located within said first diametric cylindrical portion about said bolt, and said washer being fixedly secured to the second end of said bolt such that said compression spring extends between said washer and the second reduced diameter cylindrical portion so as to bias said hanger member into said arched-shaped concavity to block access to said two symmetrical passageways but permitting said hanger member to be pulled from said arched-shaped concavity and rotated to permit access to said two symmetrical passageways.

* * * * *